US007237393B2

(12) United States Patent
Chung et al.

(10) Patent No.: US 7,237,393 B2
(45) Date of Patent: Jul. 3, 2007

(54) ICE-MAKING APPARATUS AND ICE-FULL STATE SENSING DEVICE THEREFOR

(75) Inventors: Sung Hoon Chung, Seoul (KR); Myung Ryul Lee, Seongnam-si (KR)

(73) Assignee: LG Electronics Inc., Seoul (KR)

( * ) Notice: Subject to any disclaimer, the term of this patent is extended or adjusted under 35 U.S.C. 154(b) by 107 days.

(21) Appl. No.: 11/130,164

(22) Filed: May 17, 2005

(65) Prior Publication Data

US 2005/0257536 A1 Nov. 24, 2005

(30) Foreign Application Priority Data

May 18, 2004 (KR) ..... 10-2004-0035293

(51) Int. Cl.
*F25C 1/12* (2006.01)

(52) U.S. Cl. ..... 62/137; 62/353

(58) Field of Classification Search ..... 62/137, 62/351, 353

See application file for complete search history.

(56) References Cited

U.S. PATENT DOCUMENTS 3,635,043 A * 1/1972 Sterling ..... 62/137
3,964,269 A * 6/1976 Linstromberg ..... 62/137
5,345,783 A * 9/1994 Nishikawa ..... 62/345
6,637,217 B2 * 10/2003 Kim et al. ..... 62/125
6,904,765 B2 6/2005 Lee et al.
2004/0261442 A1 12/2004 Chung et al.
2005/0066670 A1 3/2005 Chung et al.
2005/0115266 A1 6/2005 Lim et al.

FOREIGN PATENT DOCUMENTS

JP 11- 083260 3/1999

OTHER PUBLICATIONS

English language Abstract of JP11-083260.

* cited by examiner

*Primary Examiner*—William E. Tapolcai
(74) *Attorney, Agent, or Firm*—Greenblum & Bernstein, P.L.C.

(57) ABSTRACT

An ice-full state sensing device for an ice making apparatus is provided. A panel disposed at a side of an ice maker to support components. An ejection unit includes an ejector supported by the panel to eject ice made by the ice maker. A driving unit rotates the ejection unit clockwise or counterclockwise within a predetermined angle range. A link unit operates in relation to the ejection unit. An ice-full state sensing lever is connected to an end portion of the link unit to sense an ice-full state of an ice bank during a vertical movement thereof by the link unit. Accordingly, the device can perform an ice-full state sensing operation in a narrow space, and the apparatus can be installed in a narrow space.

22 Claims, 10 Drawing Sheets

ICE-MAKING APPARATUS AND ICE-FULL STATE SENSING DEVICE THEREFOR

BACKGROUND OF THE INVENTION

1. Field of the Invention

The present invention relates to an ice-making apparatus of a refrigerator, and more particularly, to an ice-making apparatus and an ice-full state sensing device therefor. The ice-making apparatus is installed at a door of a refrigerator and a sensing lever of the apparatus is configured to have a shorter length than the related art lever, whereby an installation volume of the apparatus can be reduced.

2. Description of the Related Art

Generally, a refrigerator discharges a cold air, which is generated through a refrigerating cycle using a compressor, a condenser, an expansion valve and an evaporator, to drop an internal temperature of the refrigerator, thereby refrigerating or cooling foods.

Recently, an automatic ice-making apparatus are further provided in a refrigerator so as for users to be able to enjoy at all desired times.

A refrigerator having the automatic ice-making apparatus mounted on a wall shelf in its freezing chamber so as to freeze an externally-supplied water is widely used. However, in this top-freezer type refrigerator, since an ice-making apparatus is further provided in its freezing chamber narrower than its refrigerating chamber, the freezing chamber becomes further narrower, thereby causing inconvenience in use.

Generally, the automatic ice-making apparatus includes an ice maker for freezing externally-supplied water into ice of a specific size by using a cold air, and an ice bank disposed below the ice maker. The ice is transferred from the ice maker in to the ice bank through an ice-transferring operation, and users can fully enjoy the ice received in the ice bank whenever he wants to enjoy it. That is, even though the users do not want to enjoy ice, the ice-maker is repeatedly operated so that ice of a predetermined amount or more can be received in the ice bank.

In order for a proper amount of ice to be received in the ice bank, it is necessary to terminate the operation of the ice maker through an ice-full state sensing operation when the ice bank is fully filled with ice.

In general, for the ice-full state sensing operation, an ice-full state sensing lever installed at the main body of the ice maker reciprocates in association of the ice-transferring operation of the ice maker. When the reciprocating motion of the lever is interfered with ice received in the ice bank, an ice-full state sensing device determines this state as an ice-full state and terminates the operation of the ice maker.

However, when the ice-full state sensing lever is long, the ice maker needs to become larger, thereby occupying more internal space of the refrigerating chamber.

That is, as the ice-full state sensing lever becomes longer, more space is necessary for the reciprocating operation of the ice-full state sensing lever and an installation space for the ice-making device is undesirably increased.

SUMMARY OF THE INVENTION

Accordingly, the present invention is directed to an ice-making apparatus and an ice-full state sensing device therefor that substantially obviate one or more problems due to limitations and disadvantages of the related art.

An object of the present invention is to provide an ice-making apparatus of a refrigerator and an ice-full state sensing device therefor that can provide more internal space of a refrigerator by minimizing the length of the ice-full state sensing lever.

Another object of the present invention is to provide an ice-making apparatus of a refrigerator and an ice-full state sensing device therefor that can improve an insulating thickness and efficiency of a refrigerator door by shallowly installing the ice-making device onto an inner surface of the refrigerator door.

A further object of the present invention is to provide an ice-making apparatus of a refrigerator and an ice-full state sensing device therefor that makes it possible to improve an operation of an ice-full state sensing lever and the efficiency of an ice ejecting or transferring operation.

Additional advantages, objects, and features of the invention will be set forth in part in the description which follows and in part will become apparent to those having ordinary skill in the art upon examination of the following or may be learned from practice of the invention. The objective and other advantages of the invention may be realized and attained by the structure particularly pointed out in the written description and claims hereof as well as the appended drawings.

To achieve these objective and other advantages and in accordance with the purpose of the invention, as embodied and broadly described herein, there is provided an ice making apparatus including: an ice maker for making ice; and an ice bank disposed below the ice maker to receive ice ejected from the ice maker, wherein the ice maker includes: an ice-making mold for receiving ice; an ejector for ejecting ice made by the ice-making mold; a pivot rotating by an external force to rotate the ejector; a cam connected to the pivot; a first link reciprocating to selectively contact with an outer surface of the cam; a second link for confining movement of the first link; a third link having a side pushed by the first link to reciprocate; a fourth link reciprocating by being pushed by the other side of the third link; and an ice-full state sensing lever fixed to an end portion of the fourth link to reciprocate over the ice bank and determine that the ice bank is fully filled with ice when the reciprocating motion thereof is confined.

In another aspect of the present invention, there is provided an ice-making apparatus including: an ice maker for making ice; an ice bank disposed below the ice maker to receive ice dropping from the ice maker, the ice bank having an opened surface facing the ice maker; an ejector for the ice made by the ice maker; a driving unit for rotating the ejector clockwise or counterclockwise within a predetermined angle range; a link unit operating in relation to the ejector and having an end portion protruded toward to a corner neighboring the ice bank; and an ice-full state sensing lever connected to an end portion of the link unit to sense an ice-full state of the ice bank during a vertical movement thereof by the link unit.

In another aspect of the present invention, there is provided a device for sensing an ice-full state in an ice making apparatus, the device including: an ejector for ejecting ice; a cam rotated together with the ejector; a first link selectively contacting with the cam and receiving one directional torque; a second link rotating relatively with respect to the cam and selectively confining the first link; a third link rotated by rotation of the first link; and an ice-full state sensing lever rotated by the third link.

Accordingly, the present invention can reduce the installation space for an ice-making apparatus. Particularly, when the inventive ice-making apparatus is installed at a refrigerator door, an insulating thickness of the refrigerator door can be increased because the installation space for the ice-making apparatus is reduced.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
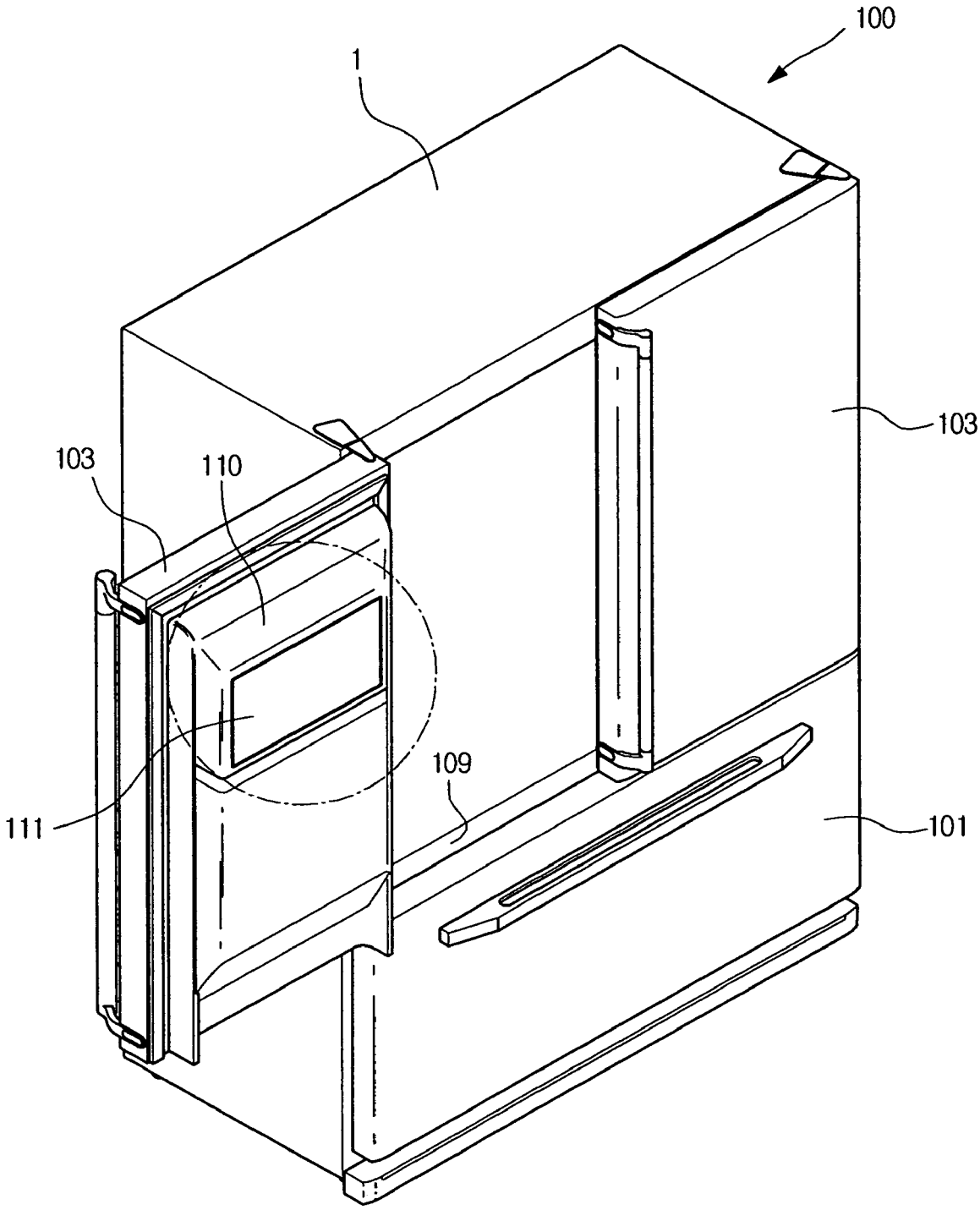
FIG. 1 is a perspective view of a bottom-freezer type refrigerator to which the present invention is applied.
Figure 2:
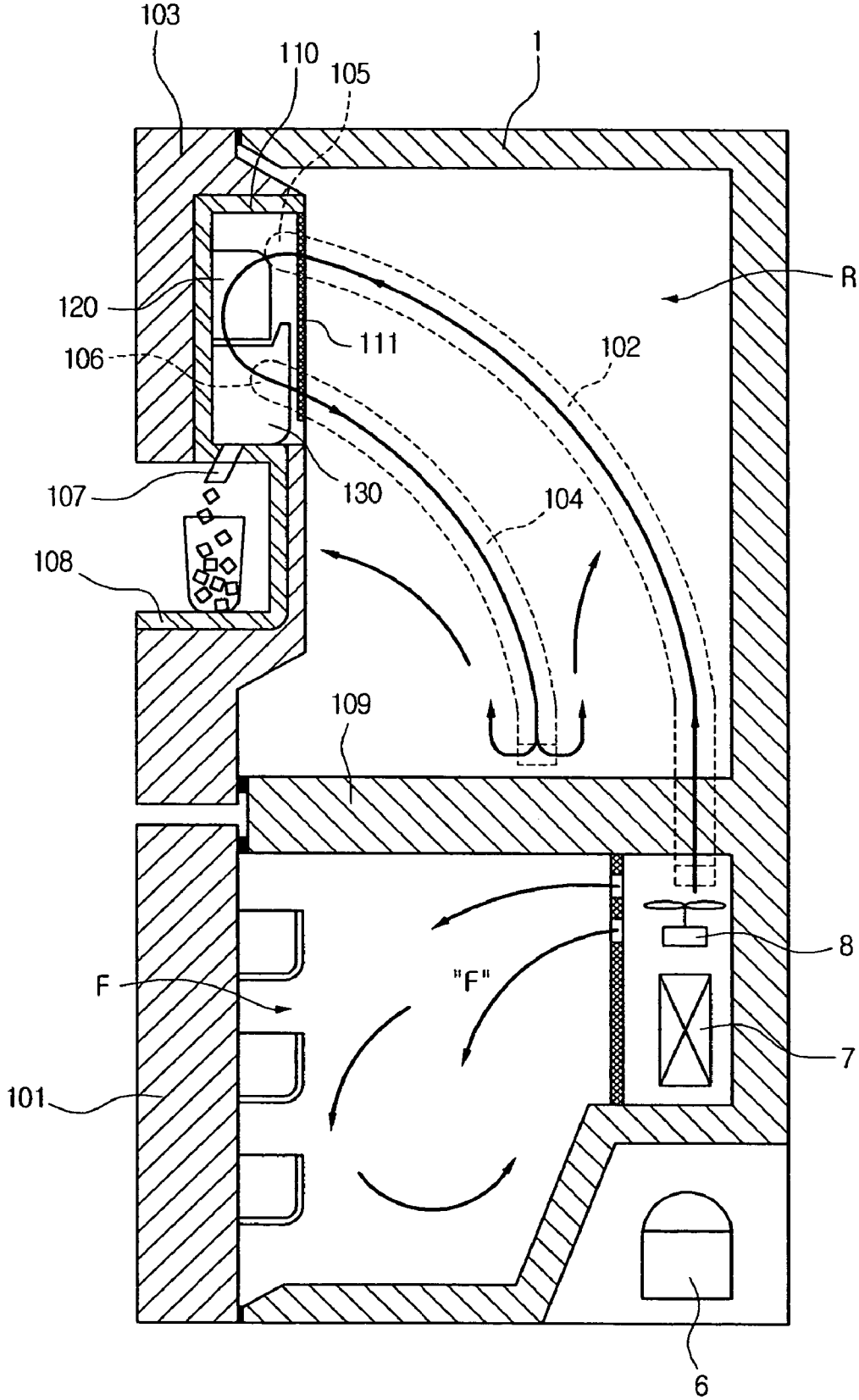
FIG. 2 is a longitudinal sectional view of the bottom-freezer type refrigerator shown in FIG. 1, for illustrating an operation thereof.

FIG. 1 is a perspective view of a bottom-freezer type refrigerator to which the present invention is applied, and FIG. 2 is a longitudinal sectional view of the bottom-freezer type refrigerator shown in FIG. 1, for illustrating an operation thereof.

Referring to FIGS. 1 and 2, a refrigerator 100 includes: a body 1 divided into an upper refrigerating chamber R and a lower freezing chamber F by a barrier 109; a refrigerating chamber door 103 and a freezing chamber door 101 for covering/uncovering the body 1; an insulating case 110 of a predetermined size installed in the refrigerating chamber door 103 so as to insulate a cold air of the freezing chamber F from that of the refrigerating chamber R; an ice maker 120 installed in a freezing space of the insulating case 110 so as to freeze water into ice by using a cold air supplied into the insulating case 110; an ice bank 130 for receiving ice ejected from the ice maker 120; and an outlet 107 and a dispenser 108 installed at a front surface of the refrigerating chamber door 103, for taking out ice received in the ice bank 130.

Also, the refrigerator 100 further includes a refrigerating cycle unit for generating a cold air necessary for refrigerating the refrigerating chamber R and the freezing chamber F. The refrigerating cycle unit includes a compressor 6, a condenser (not shown), an expansion valve (not shown), an evaporator 7, and a blower fan 8.

Also, an inner space of the insulating case 110 is further sealed with an insulating door 111. The insulating case 110 and the insulating door 111 are formed of an insulator so that the refrigerating chamber's cold air higher in temperature than the freezing chamber's cold air may not flow into the ice maker 120 and the ice bank 130 that are installed at an inner side of the refrigerating chamber door 103.

Also, the insulating case 110 is formed on an extension line of a door liner. A cold air inlet 105 for receiving a cold air to be used for making ice (hereinafter referred to as an ice-making cold air) and a cold air outlet 106 for discharging a cold air having been used for making ice (hereinafter referred to as a used ice-making cold air) are formed at a side of the insulating case 110. A cold air supply duct 102 has an end portion communicating with the cold air outlet 106 and the other end portion installed inside the barrier 109 or a side wall of the body 1. A cold air discharge duct 104 is installed to communicate with the cold air outlet 106 so as to discharge a used ice-making cold air of an ice-making chamber into the refrigerating chamber R. Here, the cold air discharge duct 104 may be installed to discharge the used ice-making cold air into the refrigerating chamber R or the evaporator 7.

An operation of the refrigerator 100 will now be described focusing on a process of generating a cold air.

First, a refrigerant is compressed from a low-temperature and high-pressure state to a high-temperature and high-pressure state while passing though the compressor 6. The high-temperature and high-pressure gaseous refrigerant is condensed and phase-changed into a high-temperature liquid refrigerant while passing through the condenser. The phase-changed high-temperature liquid refrigerant is expanded while passing through the expansion valve. The expanded refrigerant flows into the evaporator 7 and refrigerates its surrounding air while being phase-changed into a low-temperature and low-pressure gaseous refrigerant by absorbing the internal heat of the refrigerator 100. Thereafter, the low-temperature and low-pressure gaseous refrigerant re-flows into the compressor 6 to thereby complete a refrigerating cycle.

An operation of the refrigerator 100 will now be described focusing on a flow process of a cold air.

First, a cold air that has been refrigerated by a refrigerant through heat exchange with the evaporator 7 is discharged into the refrigerator 100 by the blower fan 8 installed over the evaporator 7. The discharged cold air may be discharged toward the refrigerating chamber R and the freezing chamber F by being diverged by a damper.

Thereafter, the cold air having been discharged toward the freezing chamber F is supplied through the cold air supply duct 102 and the cold air inlet 105 to the ice maker 120 and the ice bank 130 in the insulating case 110. Here, the ice maker 120 and the ice bank 130 constitute an ice-making apparatus.

At this time, the ice maker 120 freezes water using a cold air, and the resulting ice is ejected from the ice maker 120 by a heater (not shown) and an ejector lever (not shown) and is then received in the ice bank 130. The ice received in the ice bank 130 can be supplied through the outlet 107 and the dispenser 108 to users.

A used ice-making cold air is discharged through the cold air outlet 106 and the cold air discharge duct 104 into the refrigerating chamber R to then decrease the internal temperature of the refrigerating chamber R. Also, the used ice-making cold air may be discharged toward the freezing chamber F or the evaporator 7.

As described above, the ice maker 120 freezes water using a cold air, and the ice bank 130 receives ice ejected from the ice maker 120. A predetermined amount of ice is loaded in the ice bank 130 so that it can be fully supplied to users at all times.

In this manner, the ice bank 130 has a predetermined empty space for supplying a desired amount of ice to a user. When ice of a specific amount or more is received in the ice bank 130 and thus the ice bank 130 is filled with ice and is unable to receive any more ice (this state will be hereinafter referred to as an ice-full state), the ice maker 120 senses such an ice-full state. Hereinafter, the ice maker 120 and an ice-full state sensing device thereof will be descried in detail.

Figure 3:
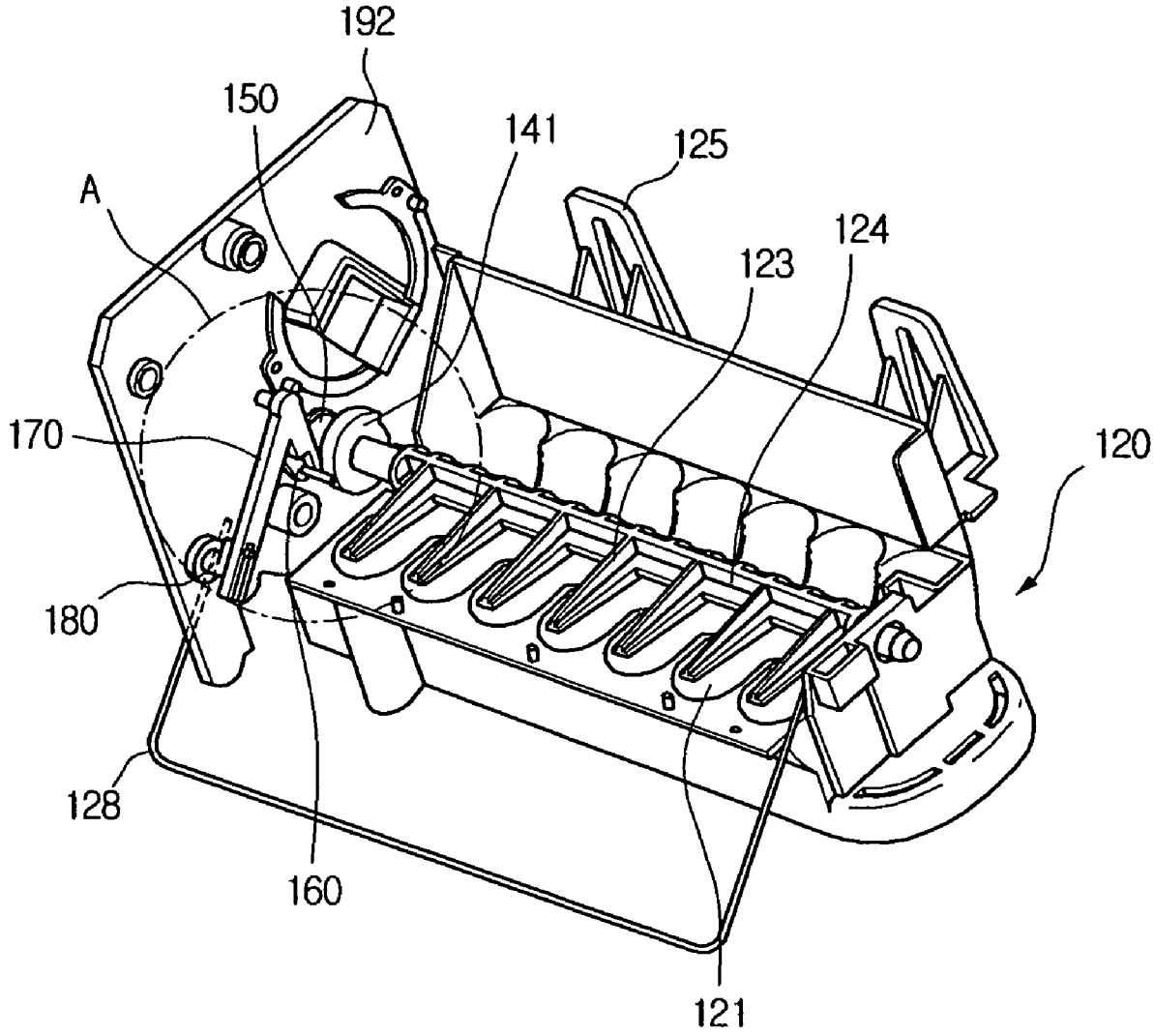
FIG. 3 is a perspective view of an ice maker according to the present invention.
Figure 4:
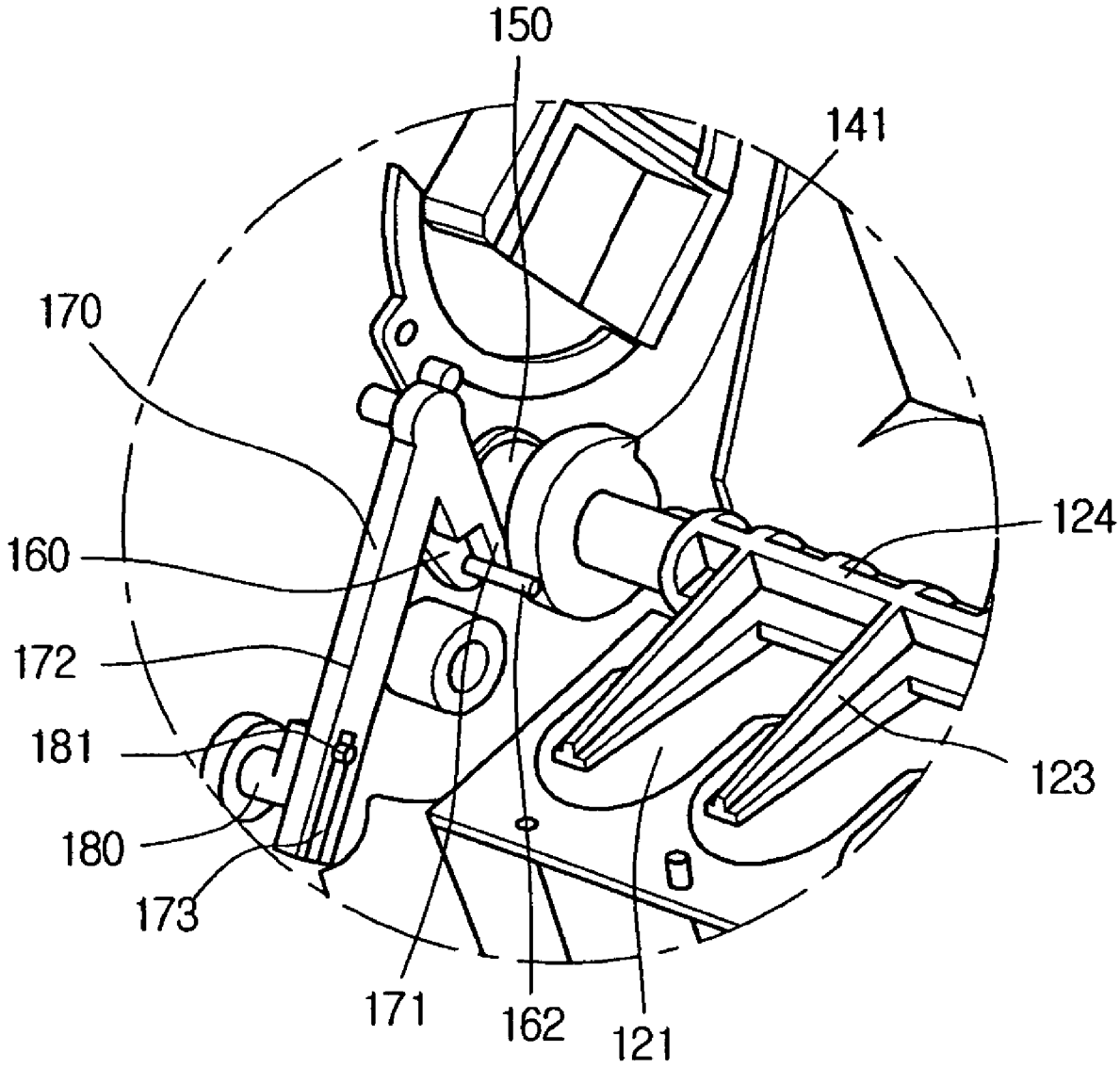
FIG. 4 is an enlarged view of a portion A shown in FIG. 3.

FIG. 3 is a perspective view of an ice maker according to the present invention, and FIG. 4 is an enlarged view of a portion A shown in FIG. 3.

Referring to FIGS. 3 and 4, the inventive ice-full state sensing device of the ice maker 120 includes: an ejector shaft 124 connected to a pivot (see 191 in FIG. 5) of a motor (see 191 in FIG. 11) to rotate clockwise or counterclockwise; a cam 141 connected to he pivot 191 to rotate together with the ejector shaft 124; a cylindrical link 150 connected to the cam 141 at a specific friction coefficient to be selectively rotated together with the cam 141, a sub-link 160 whose rotation is restricted by the cylindrical link 150 in a state of being applied with torque a certain torque; a "∠"-shaped main link 170 rotating interlocked with the sub-link 160; a terminal link 180 rotating at a rotational radius of the main link 170 in the counter direction with respect to the main link 170; and an sensing lever 128 connected to the terminal link 180 to sense the ice-full state of the ice bank 130. Hereinafter, the sensing lever 128 will be simply referred to as a sensing lever.

Generally provided are an ice-making mold 121 for freezing water, an ejector pin 123 for lifting ice in the ice-making mold 121, and a fixing hook 125 for fixing the ice maker 120 to a door.

An operation of the ice maker 120 will now be described in detail.

First, water is supplied into the ice-making mold 121 and is frozen by a cold air. The ejector shaft 124 and the ejector pin 123 are rotated to lift ice in the ice-making mold 121, and the lifted ice is received in the ice bank 130. Meanwhile, when the ice bank 130 is overfilled with ice, the full-ice sensing lever 128 senses the resulting ice-full state of the ice bank 130, whereby an operation of the ice maker 120 is automatically stopped.

A construction and operation of an ice-full state sensing device of the ice maker 120 will now be described in detail.

Referring to FIG. 4, the ejector shaft 124 and the cam 141 are simultaneously rotated, and the cam 141 and the cylindrical link 150 are simultaneously rotated selectively. A frictional member (see 152 in FIG. 5) may be further provided between the cylindrical link 150 and the cam 141 so that the link 150 and the cam 141 can be relatively rotated with respect to each other. Also, a stopping protrusion (see 151 in FIG. 5) is provided at a periphery of the cylindrical link 150 so that the cylindrical link 150 and the cam 141 can start to be rotated differently with respect to each other. Further, a stopping groove (see 161 of FIG. 5) is formed at the sub-link 160's portion corresponding to the stopping protrusion 151.

A guide protrusion 162 is provided to extend perpendicularly from the sub-link 160 and to contact with a periphery of the cam 141. A spring (see 163 in FIG. 5) is connected to an end portion of the sub-link 160 so as to always provide force for rotating the sub-link 160 counterclockwise.

An interaction among the cam 141, the cylindrical link 150, and the sub-link 160 will now be described in brief.

Although the sub-link 160 will always rotate counterclockwise by the spring 163, it cannot rotate when the guide protrusion 162 is supported by the cam 141. In this state, since the cam 141 is divided into two parts having different diameters, it can rotate within a specific angle range. Also, the stopping protrusion 151 contacts with the stopping groove 161, the sub-link 160 cannot rotate counterclockwise because it is supported also by the cylindrical link 150.

An end portion of the main link 170 can rotate by being pushed by the guide protrusion 162.

A slot 173 is provided at the other end portion of the main link 170 in the longitudinal direction thereof, and a protrusion 181 of the terminal link 180 is inserted into the slot 173. Since the protrusion 181 is extended from a bent portion, it causes the terminal link 180 to rotate during the rotation of the main link 170.

The protrusion 181 formed at an end portion of the terminal link 180, and an end portion of the sensing lever 128 is inserted into the other end portion of the terminal link 180.

Accordingly, when the terminal link 180 rotates by the protrusion 181, the sensing lever 128 also simultaneously rotate, whereby an ice-full state of the ice bank 130 can be sensed.

The sub-link 160, the main link 170 and the terminal link 180 are rotatably connected to a panel 192 by a pivot. The main link 170 and the sensing lever 128 will always rotate counterclockwise on a supporting point of the panel 192 due to their weights. Here, the link 170 and the lever 128 may rotate by their weights or by a spring.

Operations of the inventive ice-making apparatus and the ice-full state sensing device thereof will now be described in detail.

Figure 5:
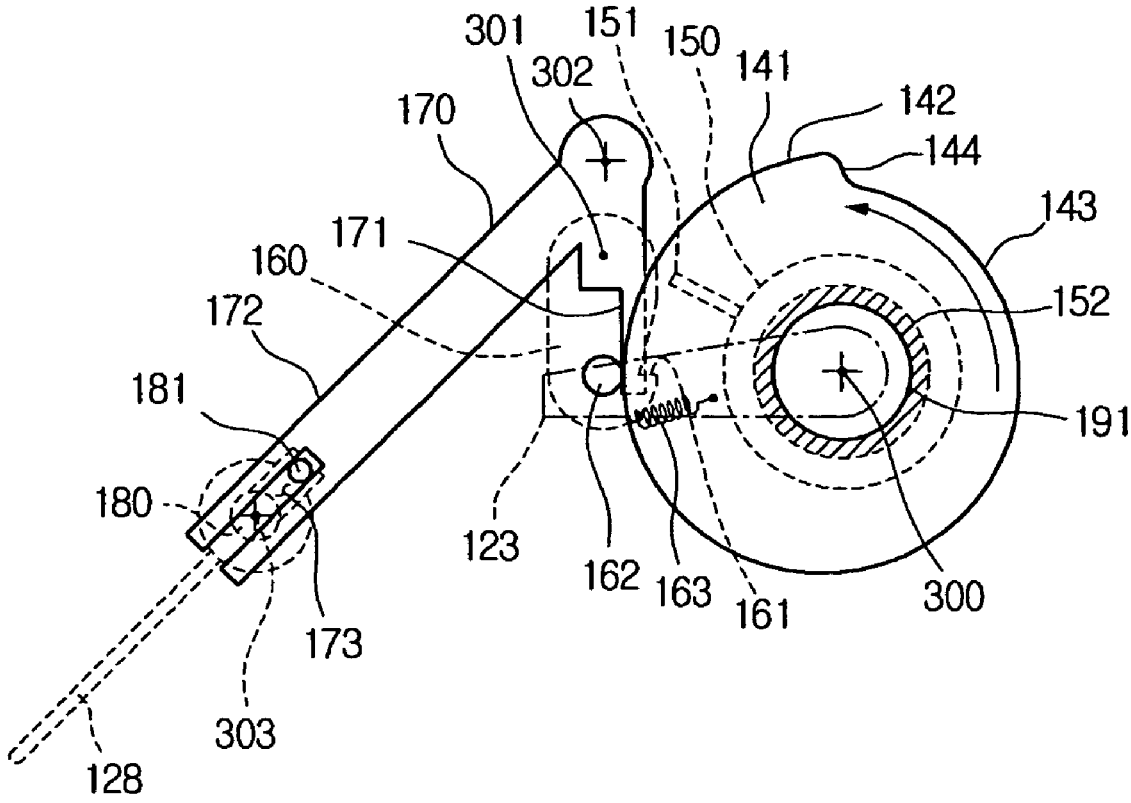
FIG. 5 is a view illustrating a state where ice starts to be ejected from an ice maker.
Figure 6:
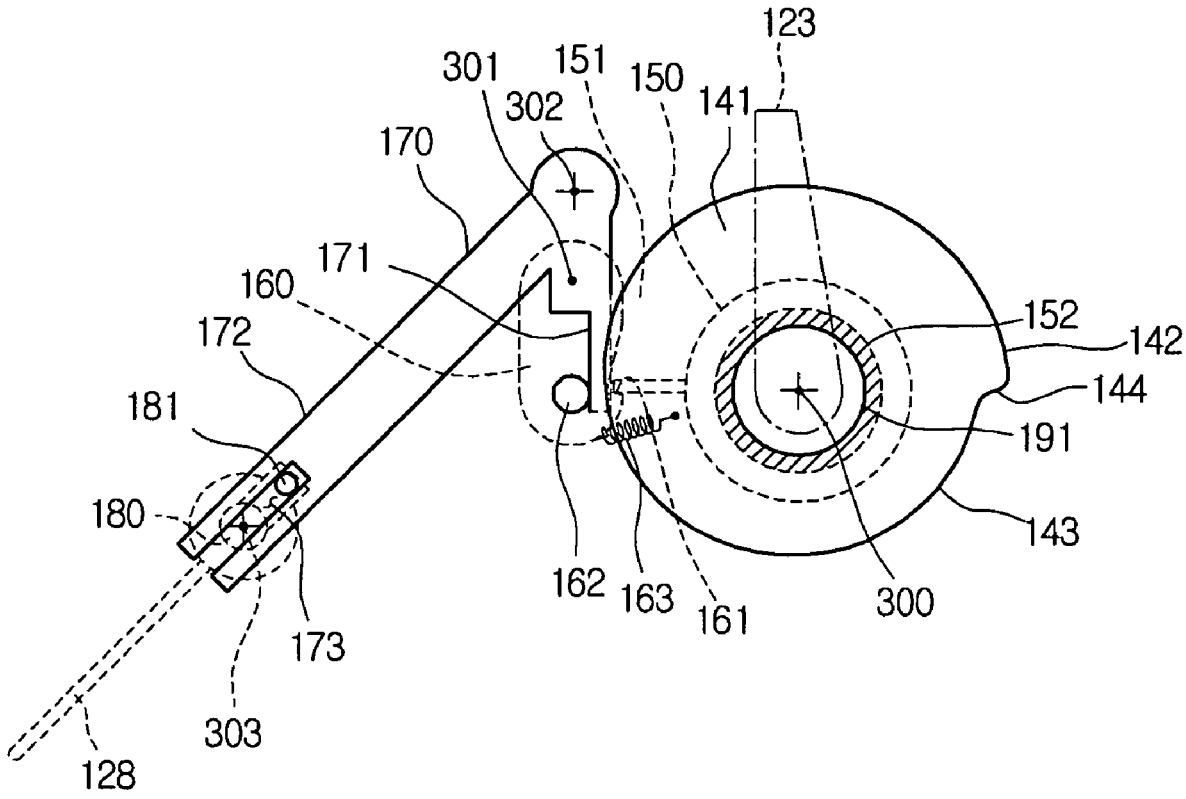
FIG. 6 is a view illustrating a state where an ice ejection operation is terminated.
Figure 7:
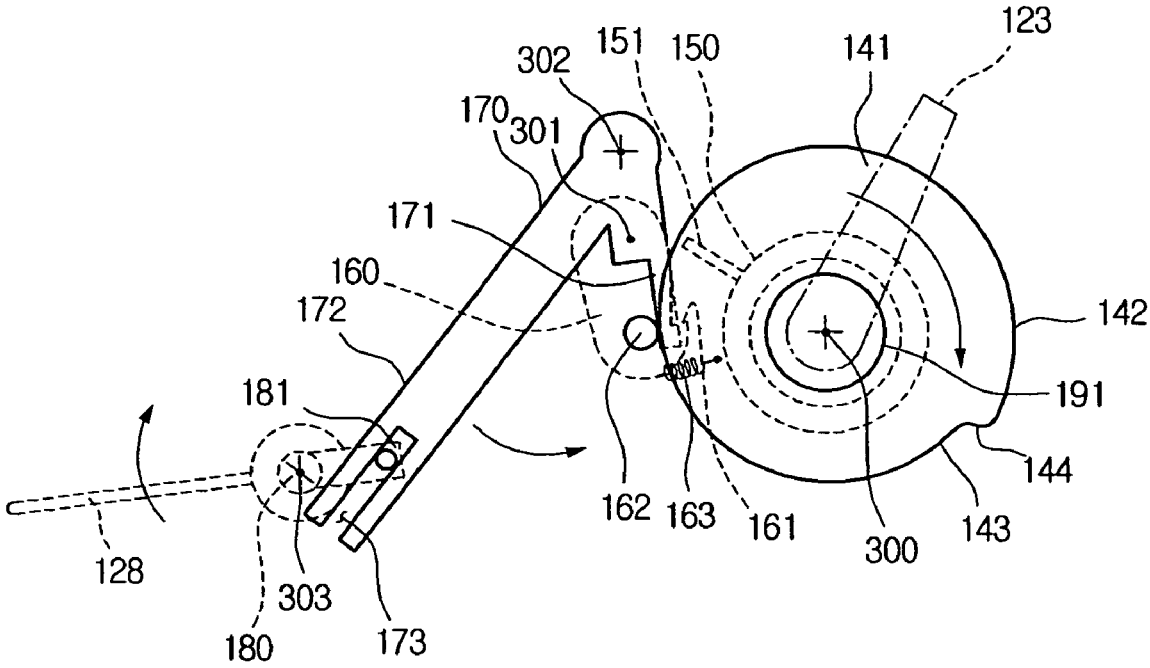
FIG. 7 is a view illustrating a state where an original position is resumed after the termination of an ice ejection operation.

FIGS. 5 to 7 are side views of the ice maker from which the ice-full state sensing device is extracted. In detail, FIG. 5 illustrates a state where ice starts to be ejected from an ice maker, FIG. 6 illustrates a state where an ice ejection operation is terminated, and FIG. 7 illustrates a state where an original position is resumed after the termination of an ice ejection operation.

Figure 11:
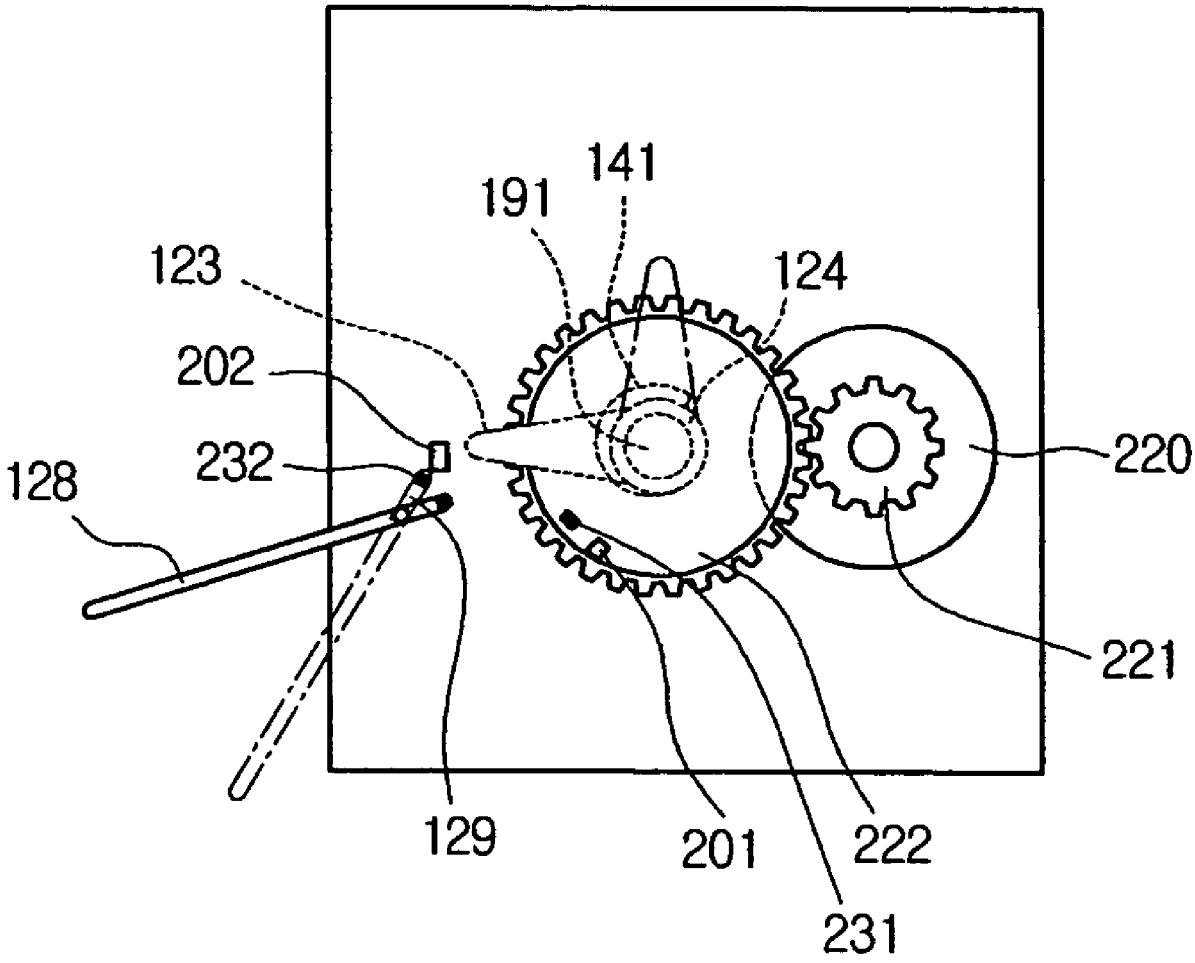
FIG. 11 is a left side view of a panel of an ice maker according to the present invention.

Referring to FIGS. 5 to 7, when an ice-making operation is completed in the ice-making mold 121, the cam 141 and the pivot 191 and the ejector shaft 124 rotate counterclockwise (that is, in a forward direction) by the driving of a motor (see 222 in FIG. 11). At this time, the ejector pin 123 protruding perpendicularly from the ejector shaft 124 also simultaneously rotates to transfer ice in the ice-making mold 121 to the ice bank 130. The ejector shaft 124 rotates by at least 270° for the ice-ejecting operation during the transition from the state of FIG. 5 to the state of FIG. 6.

Thereafter, upon completion of the ice-ejecting operation, the cam 141 and the pivot 191 and the ejector shaft return to their original positions by rotating clockwise (that is, in a reverse direction) as shown in FIG. 7.

The operation of the ice-full state sensing device will now be described in more detail.

First, pivot points of the corresponding components will now be described. The cam 141, the pivot 191 and the cylindrical link 150 are supported by and rotated on a first pivot point 300. The sub-link 160 is supported by and rotated on a second pivot point 301, the main link 170 a third pivot point 302, and the terminal link 180 a fourth pivot point 303.

When an ice-ejecting operation is initiated after completion of an ice-making operation, the motor and the pivot 191 rotate. When the pivot 191 rotates counterclockwise, the cylindrical link 150 also rotates by a frictional force because the frictional member 152 is interposed between the cam 141 and the cylindrical link 150. Here, the frictional member 152 may be formed between the cylindrical link 150 and the cam 141, or between the cylindrical link 150 and the pivot 191, in such a way that the cylindrical link 150 can rotate relatively with respect to the pivot 191 and the cam 141.

Figure 9:
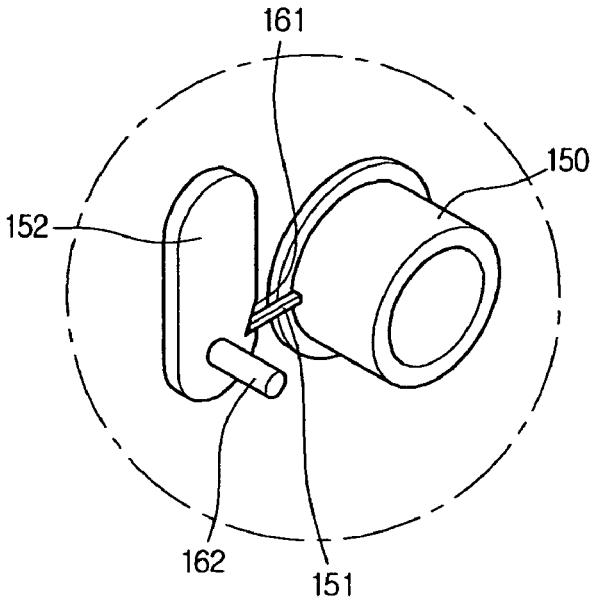
FIG. 9 is a view illustrating a state where the stopping groove and the stopping protrusion are confined by each other.

When the stopping protrusion 151 contacts with the stopping groove 161 of the sub-link 160 during the rotation of the cylindrical link 150, the cylindrical link 150 rotates idly in spite of the interposition of the frictional member 152 between it and the cam 141 because the rotation of the cylindrical link 150 is restricted by the stopping protrusion 151. At this time, the sub-link 160 also does not rotate counterclockwise in spite of the spring 163 connected thereto. At this time, the spring 163 may have an end portion caught in the sub-link 160 and the other end portion caught in the panel 192 to thereby apply a counterclockwise torque to the sub-link 160. A state where the stopping groove and the stopping protrusion are confined by each other is illustrated in FIG. 9.

Figure 8:
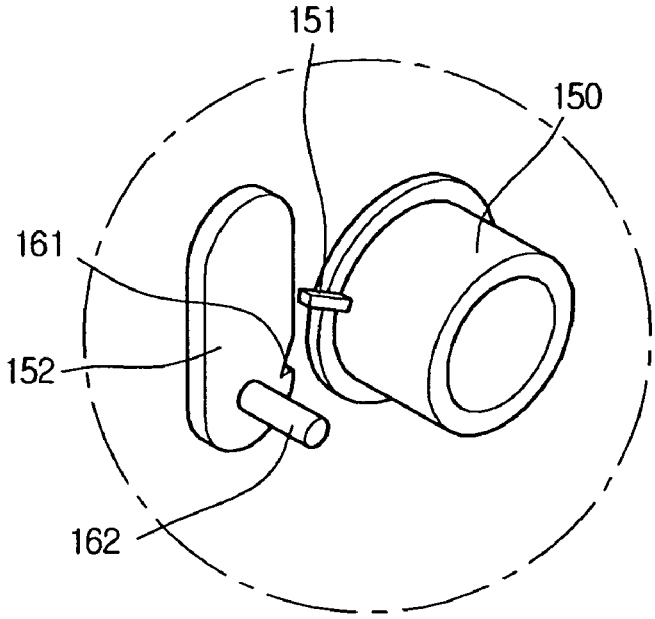
FIG. 8 is a view illustrating a state where a stopping groove and a stopping protrusion are not affected by each other.

After an ice-ejecting operation is completed by the continuous counterclockwise rotation of the cam 141, the cam 141 rotates clockwise to thereby return to its original position. This clockwise rotation of the cam 141 causes the stopping protrusion 151 to rotate clockwise and thereby separate from the stopping groove 161. This state where a stopping groove and a stopping protrusion are not affected by each other is illustrated in FIG. 8.

During the clockwise rotation of the cam 141 after completion of an ice-ejecting operation, the full-ice sensing lever 128 senses whether or not the ice bank 130 is fully filled with ice.

An ice-ejecting state according to a rotational state of the cam 141 will now be described in detail.

First, the sub-link 160 will rotate counterclockwise by the spring 163. However, when the stopping protrusion 151 of the cylindrical link 150 is caught in the stopping protrusion 161 of the sub-link 160 or when the guide protrusion 162 protruding perpendicularly from the sub-link 160 contacts with a second circumferential surface 143 of the cam 141, the counterclockwise rotation of the sub-link 160 is restricted.

Here, the cam 141 has formed thereon a first circumferential surface 142 and the second circumferential surface 143 whose outer diameter is smaller than that of the surface 142. Also, a round jaw 144 is provided at a contact position between the surfaces 142 and 143. Accordingly, when the cam 141 rotates by a predetermined angle, whether or not the sub-link 150 can rotate is determined by a radius difference between the surfaces 142 and 143.

Until the cam 141 rotates by a predetermined forward angle 270° after initiation of an ice-ejecting operation, although the cam 141 is spaced apart from the guide protrusion 162 of the sub-link 160 by the second circumferential surface 143, the sub-link 150 continue to stop at a previous position because the stopping protrusion 151 is caught in the stopping groove 161. At this time, a shot link 171 of the main link 170, which is adjacent to a rotational direction of the guide protrusion 162, also continues to stop due to confinement by the sub-link 160.

Accordingly, the terminal link 180 connected to the main link 170 also maintains its current position, and the sensing lever 128 connected to the terminal link 180 also maintains its initial state where it does not move.

Therefore, even until an ice-ejecting operation is terminated, the sensing lever 128 does not operate and thus the lever 128 and ice do not interfere with each other during the ice-ejecting operation.

Thereafter, upon completion of the ice-ejecting operation, when the motor counter-rotates (that is, rotates reverse) so that the lever 128 can return to its original position, the cam 141 also counter-rotates. At this time, the cylindrical link 150 also counter-rotates, whereby the stopping protrusion 151 separates from the stopping groove 161. In this state, according to the rotation of the cam 141, a surface on which the cam 141 and the sub-link 160 contact with each other moves from the first circumferential surface 142 to the second circumferential surface 142. Accordingly, the guide protrusion 162 of the sub-link 160 rotates counterclockwise by a frictional force of the spring 163. That is, the guide protrusion 162 rotates by a radius difference between the first circumferential surface 142 and the second circumferential surface 142. This state is illustrated in FIG. 7.

At this time, the shot link 171 of the main link 170 is pushed by the guide protrusion 162 of the sub-link 160 to thereby rotate counterclockwise by a rotation angle of the sub-link 160, and a long link 172 oppositely connected to the pivot also rotates counterclockwise.

As the long link 172 rotates counterclockwise, the terminal link 180's protrusion 181 connected to the slot 173 rotates on the fourth pivot point 303 clockwise.

As the terminal link 180 rotates clockwise, the sensing lever 128 inserted and connected into the terminal link 180 also rotates clockwise. That is, the sensing lever 128 locates in the ice bank 130 in its initial state, and senses an ice-full state of the ice bank 130 when it rotates clockwise.

Even when the main link 180 rotates by a narrow angle, the rotation angle of the sensing lever 128 can be greatly amplified by the terminal link 180. That is, as a distance between the fourth pivot point 303 and the protrusion 181 becomes shorter, the terminal link 180 can rotate by a greater angle even when the main link 180 rotates by the same angle. Therefore, by adjusting the distance between the fourth pivot point 303 and the protrusion 181, the rotation angle of the sensing lever 128 can be conveniently adjusted.

Thereafter, when the cam 141 continue to rotate and thereby the first circumferential surface 142 pushes the guide protrusion 162 of the sub-link 160 toward its original position, the guide protrusion 162 moves to its original position and the shot link 171 of the main link 170 returns to its original position by the weight of the main link 170. Alternatively, the short link 171 may return to its original position by a separate spring of the main link 170.

At this time, the long link 172 of the main link 170 rotates clockwise and simultaneously the terminal link 180 rotates counterclockwise. Accordingly, the sensing lever 128 also moves counterclockwise to return to its initial position.

Unless the ice bank 130 is fully filled with ice when the sensing lever 128 moves to its initial position, the sensing lever 128 can return to its initial position. However, if the ice bank 130 is fully filled with ice, the sensing lever 128 cannot move downward (that is, counterclockwise) and return to its initial position due to the fully-loaded ice, and is confined at an upper position. When the sensing lever 128 cannot return to its initial position, the ice-maker 120 determines that the ice bank 130 has been fully filled with ice to thereby stop its operation. Accordingly, when the ice bank 130 has been fully filled with ice, the ice maker 120 does not make any more ice.

As described above, the inventive ice-full state sensing device can reliably sense the ice-full sate of the ice bank 130 disposed below the ice maker 120. Also, even though the sensing lever 128 is short, the ice-full state sensing device can reliably sense the ice-full state of the ice bank 130 because the sensing lever 128 is installed at the ice maker 120's lower side adjacent to an upper side of the ice bank 130.

Figure 10:
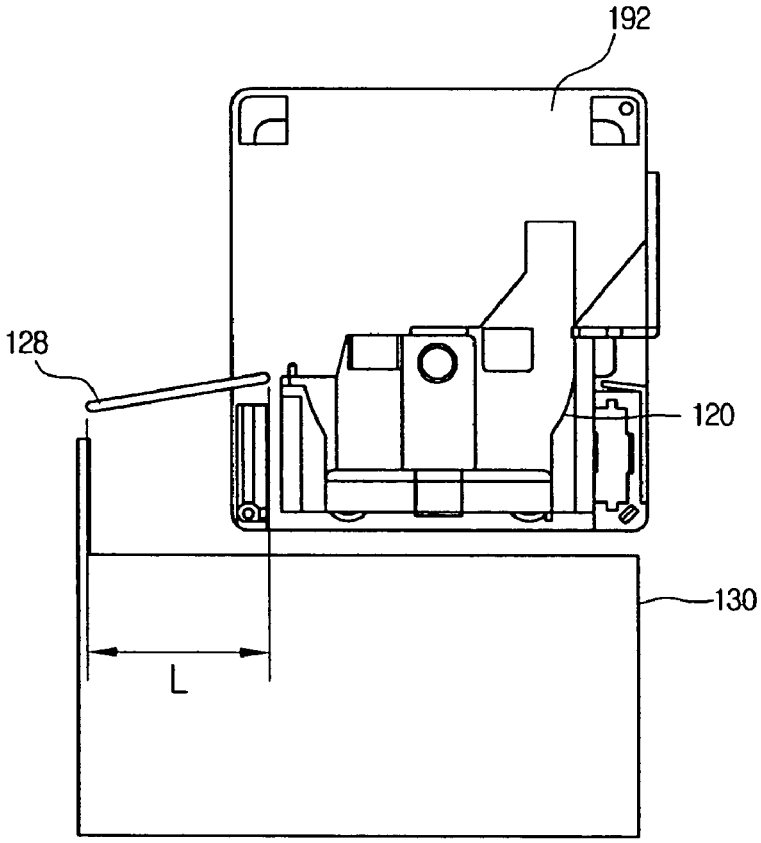
FIG. 10 is a schematic side view of an ice maker according to the present invention.

FIG. 10 is a schematic side view of the ice maker according to the present invention.

Referring to FIG. 10, the sensing lever 128 is provided to have a trajectory radius identical to or smaller than the horizontal width of the ice bank 130 and to reliably sense the ice-full state of the ice bank 130. A rotational radius L of the sensing lever 128 does not deviate from a left end portion of the ice bank 130 as shown in FIG. 10.

Also, it can be readily appreciated from FIG. 10 that the rotational radius L of the lever 128 can become shorter because the sensing lever 128 is supported by the terminal link 180 at a lower corner of the panel 192 and the main link 170 extends toward the terminal link 180.

Reference will now be made in detail to a structure and operation for controlling at the ice-full state sensing device an ice-full state sensing operation according to a moving state of the sensing lever.

Figure 12:
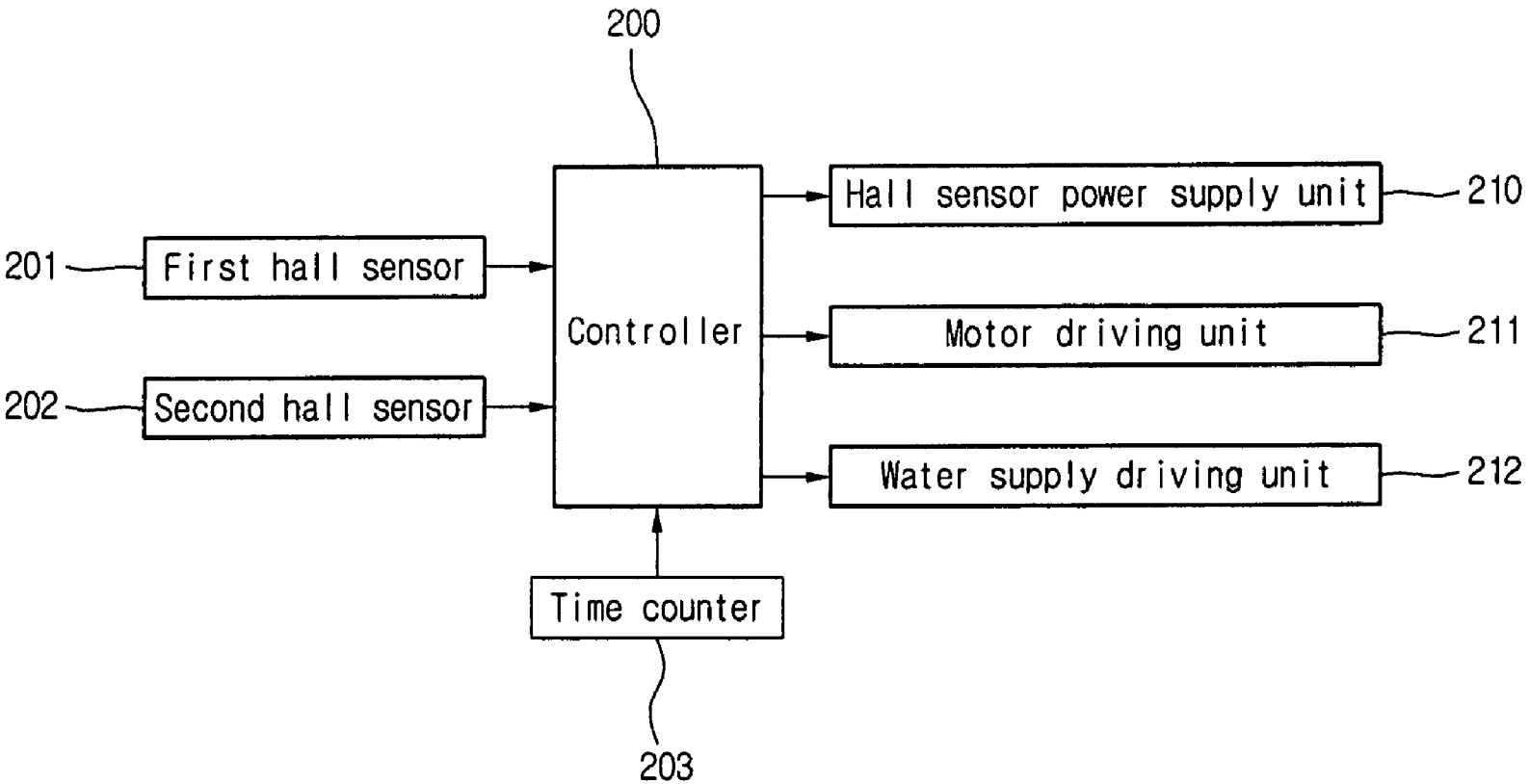
FIG. 12 is a block diagram of a system for controlling a full-ice-state sensing device according to the present invention.

FIG. 11 is a left side view of a panel of an ice maker according to the present invention, and FIG. 12 is a block diagram of a system for controlling the full-ice-state sensing device according to the present invention.

Referring to FIG. 11, a sensor unit for sensing a position of the sensing lever 128 includes first and second hall sensors 201 and 202, and first and second magnets 231 and 232. The first hall sensor 201 and the first magnet 231 constitute a first sensing unit, and the second hall sensor 202 and the second magnet 232 constitute a second sensing unit.

When a driving gear 221 rotates by a torque of a motor 220, a driven gear 222 engaged with the driving gear 221 repeatedly rotates clockwise or counterclockwise at a predetermined period. The first magnet 231 is installed at a side of the driven gear 222, and the first hall sensor 201 is installed at the panel 192 (or an equivalent substrate) at a position facing the first magnet 231. The ejector shaft 124 is installed coaxially with a pivot 191 of the driven gear 222.

According to the clockwise or counterclockwise rotation of the driven gear 222, the ejector shaft 134 also rotate together with the driven gear 222. When the first magnet 231 reaches a position where the first hall sensor 201 can sense it (hereinafter simply referred to as a "sensing position"), the first hall sensor 201 generates a sensing signal indicating that an initial position of the ejector shaft 124 is sensed. Here, the first hall sensor 201 and the first magnet 231 are installed at a position where the initial position of the ejector shaft 124 can be sensed.

The cam 141 is rotatably installed on the pivot 191 and rotates. In order to vertically move the sensing lever 128, the torque of the cam 141 is transferred through the cylindrical link 150, the sub-link 160, the main link 170 and the terminal link 180 to the sensing lever 128. The terminal link 180 is interlocked with the sensing lever 128. The sensing lever 128 has an elongated portion 129 at the other end portion thereof and pivots according to the rotational direction of the main link 170.

In order to sense an ice-full state of the ice bank 130, the second magnet 232 is installed at the elongated portion 129 of the sensing lever 128 and the second hall sensor 202 for detecting the position of the second magnet 232 is installed at the panel 192 or an equivalent fixed substrate. Here, the second hall sensor 202 is installed at a predetermined position such that the sensing lever 128 can sense the ice-full state. Accordingly, when the second magnet 232 reaches a sensing position for the second hall sensor 202, the second hall sensor 202 outputs a sensing signal for determining whether or not an ice-full state has occurred.

If the sensing lever 128 does not move downward any more, that is, if the sensing lever 128 does not return to its original position due to an ice-full state, the hall sensor 202 senses the position of the second magnet 232 and outputs a sensing signal. At this time, when the sensing signal from the second hall sensor 202 is detected longer than a predetermined time period, it is determined that an ice-full state has occurred.

An operation of the ice-full state sensing device will now be described with reference to FIG. 12.

Referring to FIG. 12, a controller 200 outputs a driving signal to a hall sensor power supply unit 210 to supply power to the first and second hall sensors 201 and 202. The hall sensors 201 and 202 become a standby state for sensing the magnets 231 and 232.

Thereafter, the controller 200 determines whether or not a sensing signal is outputted from the hall sensors 201. When an initial position of the ice-making apparatus is sensed by the first sensing unit, the controller 200 controls a water supply unit 212 to supply water to the ice-making mold of the ice maker.

Here, when the ejector shaft 124 is located at its initial position, the first hall sensor 201 senses the first magnet 231 and outputs a predetermined sensing signal to the controller 200. The controller 200 determines the position of the ejector shaft 124 by using the initial position sensing signal, and recognizes whether or not a water supply operation and an ice-ejecting operation is completed.

When an ice-making operation is completed, the controller 200 controls a motor driving unit 211 to drive the motor 220 and the gears 221 and 222. Accordingly, an ice-ejecting operation is initiated. Here, a clockwise and counterclockwise rotation of the motor 220 is repeated periodically within a predetermined angle range. This rotational radius can be applied to an ice-making mold cover.

When the ice-ejecting operation is completed by the rotation of the ejector shaft 124 by 270°, the second hall sensor 202 senses a state where the sensing lever 128 is located at an ice-full state sensing position. In this state, when sensing the second magnet 232, the second hall sensor 202 outputs a sensing signal.

Accordingly, when the ice bank 130 is not fully filled with ice, the clockwise or counterclockwise rotation of the cam 114 by the control of the motor driving unit 211 causes the sensing lever 128 to move upward (see a solid line in FIG. 11) or downward (see an imaginary broken line in FIG. 11).

When the sensing lever 128 is located at an upper position, a sensing signal indicating that the second magnet 232 is sensed by the second hall sensor 202 is outputted, and the sensing lever 128 returns to a lower position by the counterclockwise rotation of the cam 141. That is, when the ice bank 130 is not fully filled with ice, the sensing signal from the second hall sensor 202 is terminated within a predetermined time period. On the contrary, when the ice bank 130 is fully filled with ice, the controller 200 detects that the sensing signal from the second hall sensor 202 is maintained longer than the predetermined time period and determines that an ice-full state is generated.

This vertical movement of the sensing lever 128 for the ice-full state sensing operation is repeated periodically when the cam 114 is clockwise or counterclockwise rotated by the torque of motor 220 for the ice-ejecting operation.

When the ice bank 230 is not fully filled with ice, the sensing lever 128 having moved to the upper position remains at the upper position even when the rotation of the gears 221 and 222 according to the ice-ejecting operation is terminated. This is because the sensing lever 128 is caught in the ice of the ice bank 130. At this time, the second hall sensor 202 senses the second magnet 232 and continuously outputs a sensing signal longer than the predetermined time period. Accordingly, the controller 200 continuously receives a sensing signal from the second hall sensor 202, and determines that an ice-full state is generated when detecting, by using a time counter 203, that the sensing signal is maintained longer than a predetermined time period. Here, the predetermined time period may be set to a time period necessary for the counterclockwise rotation of the motor 220.

In response to the ice-full state sensing signal from the second hall sensor 202, the controller 200 terminates an ice-making operation and an ice-ejecting operation and then becomes a standby state for waiting for the sensing lever to return to its initial state. At this time, when the sensing lever 128 returns to its original position due to a discharge of ice, the ice maker 120 can initiate its operation.

The present invention aims at installing the ice-making apparatus at an inner side of the refrigerator chamber door or the freezing chamber door and then sensing the ice-full state of the ice tank. It should be apparent to those skilled in the art that the construction and operation of the present invention can be applied to a top-mount type refrigerator having a freezing chamber and a refrigerating chamber partitioned up and down, a side-by-side type having a freezing chamber and a refrigerating chamber partitioned left and right as well as a bottom-freezer type refrigerator having a freezing chamber and a refrigerating chamber partitioned up and down.

The refrigerator is classified into a top mount-type refrigerator having a freezing chamber and a cold chamber partitioned up and down, a bottom freezer-type refrigerator having a cold chamber and a freezing chamber partitioned up and down, and a side-by-side type refrigerator having a freezing chamber and a cold chamber partitioned left and right.

As described above, the present invention can reduce the length of the ice-full state sensing lever and the size of the ice-making device, thereby making it possible to solve a problem of deficiency in an inner space of a refrigerator.

Also, the ice-full state lever is not interfered with ice of the ice bank during the clockwise rotation thereof and operates only during the counterclockwise operation thereof, whereby a problem of its interference with ice can be solved.

Moreover, the ice-making apparatus can be shallowly installed in an inner surface of a refrigerator door, whereby an insulating thickness of the refrigerator can be increased.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An ice making apparatus, comprising:

an ice maker that makes ice; and an ice bank disposed below the ice maker to receive ice ejected from the ice maker, the ice maker comprising:

an ice-making mold in which ice is formed;

an ejector that ejects ice formed in the ice-making mold;

a pivot rotating by an external force to rotate the ejector;

a cam connected to the pivot;

a first link that reciprocates and selectively contacts an outer surface of the cam;

a second link that confines movement of the first link;

a third link having a first side that reciprocates when pushed by the first link;

a fourth link that reciprocates when pushed by a second side of the third link; and an ice-full state sensing lever fixed to an end portion of the fourth link to reciprocate over the ice bank and determine that the ice bank is fully filled with ice when a reciprocating motion thereof is confined.

2. The apparatus according to claim 1, wherein the ice-full state sensing lever has an end portion supported at a lower portion of the ice maker.

3. The apparatus according to claim 1, wherein the cam rotates counterclockwise and clockwise during an ice ejecting operation.

4. The apparatus according to claim 1, wherein the ice-full state sensing lever has a first portion of a small diameter and is rotated upward when the first portion contacts with the first link.

5. The apparatus according to claim 1, wherein the ice-full state sensing lever does not move when the first link is confined by the second link.

6. The apparatus according to claim 1, further comprising:

a groove provided in the first link to confine the first link; and a protrusion protruding from the second link.

7. The apparatus according to claim 1, further comprising a frictional member which rotates the second link, the frictional member being disposed between the second link and one of the cam and the pivot.

8. The apparatus according to claim 1, wherein the ice-full state sensing lever does not move when ice is ejected from the ice maker.

9. The apparatus according to claim 1, wherein the ice-full state sensing lever is moved upward when the ejector returns to an original position thereof after termination of ejection of ice from the ice maker.

10. The apparatus according to claim 1, further comprising a spring that provides a force that rotates the first link in one direction.

11. The apparatus according to claim 1, wherein at least one of the third link and the fourth link rotates by a weight thereof.

12. The apparatus according to claim 1, wherein the first, second, third and fourth links are supported by and rotated on different pivot points.

13. The apparatus according to claim 1, further comprising:

a slot formed at an end portion of the third link; and a protrusion protruding from the fourth link and guided by the slot.

14. The apparatus according to claim 1, further comprising a slot protruding from the first link to push the third link.

15. The apparatus according to claim 1, further comprising:

a sensed part provided at a side of the ice-full state sensing lever; and a sensor that senses a position of the sensed part when the ice-full state sensing lever moves upward.

16. A device for sensing an ice-full state in an ice making apparatus, comprising:

an ejector that ejects ice;

a cam that rotates together with the ejector;

a first link that selectively contacts the cam and receives one directional torque;

a second link that rotates with respect to the cam and selectively confines the first link;

a third link that is rotated by a rotation of the first link; and an ice-full state sensing lever that is rotated by the third link.

17. The device according to claim 16, further comprising a fourth link provided at a connection portion between the third link and the ice-full state sensing lever to amplify a rotational angle of the ice-full state sensing lever.

18. The device according to claim 16, wherein a state where the ice-full state sensing lever is unable to move downward after moving to an upper position is determined as the ice-full state.

19. An ice-making apparatus, comprising:

an ice maker that makes ice;

an ice bank disposed below the ice maker to receive ice which drops from the ice maker, the ice bank having an opened surface facing the ice maker;

an ejector that ejects the ice made by the ice maker;

a driver that rotates the ejector within a predetermined angle range;

a link operating in relation to a shaft of the ejector and having an end portion protruding toward a corner neighboring the ice bank; and an ice-full state sensing lever connected to an end portion of the link to sense an ice-full state of the ice bank during a vertical movement thereof by the link.

20. The apparatus according to claim 19, wherein an ice-full state of the ice bank is sensed depending on a delay from a time point when the ice-full state sensing lever completely moves to a highest position to a time point when the ice-full state sensing lever starts to move downward.

21. The apparatus according to claim 19, wherein the ejector moves respective to an ice-making mold to remove ice from the ice-making mold.

22. The apparatus according to claim 21, wherein the ejector comprises a plurality of pins which lift ice out of the ice-making mold.

* * * * *